US009756685B2

(12) United States Patent
Tuengler et al.

(10) Patent No.: US 9,756,685 B2
(45) Date of Patent: Sep. 5, 2017

(54) HEATING ELEMENT

(71) Applicant: Thermofer GmbH & Co. KG, Cologne (DE)

(72) Inventors: Soeren Tuengler, Lippetal (DE); Hans-Georg Koch, Leverkusen (DE); Margarete Franziska Althaus, Schmallenberg (DE)

(73) Assignee: THERMOFER GMBH & CO. KG, Cologne (DE)

( * ) Notice: Subject to any disclaimer, the term of this patent is extended or adjusted under 35 U.S.C. 154(b) by 0 days.

(21) Appl. No.: 14/685,472

(22) Filed: Apr. 13, 2015

(65) Prior Publication Data

US 2015/0296567 A1 Oct. 15, 2015

(30) Foreign Application Priority Data

Apr. 11, 2014 (DE) ..... 10 2014 105 215.3

(51) Int. Cl.
*H05B 1/02* (2006.01)
*H05B 3/34* (2006.01)
*H05B 3/36* (2006.01)

(52) U.S. Cl.
CPC ..... *H05B 3/347* (2013.01); *H05B 3/36* (2013.01); *H05B 2203/015* (2013.01); *H05B 2214/04* (2013.01)

(58) Field of Classification Search
CPC .... H05B 3/347; H05B 1/02; H05B 2203/015; H05B 2214/04; H05B 3/36; H05B 3/34
USPC ..... 219/494, 504, 544, 529, 549, 545
See application file for complete search history.

(56) References Cited

U.S. PATENT DOCUMENTS 6,649,886 B1 * 11/2003 Kleshchik ..... H05B 3/347 165/104.28
8,897,888 B2 * 11/2014 Parker ..... A61M 25/0009 181/229
2001/0025846 A1 * 10/2001 Kochman ..... H02H 5/043 219/545
2007/0210074 A1 * 9/2007 Maurer ..... B60N 2/5685 219/549
2008/0083740 A1 * 4/2008 Kaiserman ..... A43B 7/04 219/520
2008/0290080 A1 * 11/2008 Weiss ..... H05B 1/0238 219/202
2009/0200285 A1 * 8/2009 Raidt ..... F24D 13/022 219/213

(Continued)

FOREIGN PATENT DOCUMENTS

DE 298 24 578 U1 8/2001
DE 20 2005 014 678 U1 9/2006

(Continued)

OTHER PUBLICATIONS

International Preliminary Report on Patentability issued on May 5, 2015 for International Application No. PCT/EP2013/072696.
Extended European Search Report dated Aug. 6, 2015.

*Primary Examiner* — Mark Paschall
(74) *Attorney, Agent, or Firm* — Knobbe Martens Olson and Bear, LLP

(57) ABSTRACT

A plane heating element includes a mesh that has warp threads and weft threads. A coating containing carbon nanotubes can be applied to the mesh. A water-repellent and electrically-insulating protective layer made of styrene butadiene copolymer can be additionally applied to the mesh.

10 Claims, 3 Drawing Sheets

110 : heat reflective foil
120 : heat insulation layer
130 : flexible synthetic resin layer containing mesh
140 : mesh
150 : carbon nanotube coating

(56) References Cited

U.S. PATENT DOCUMENTS

| | | | | |
|---|---|---|---|---|
| 2011/0036828 | A1 | 2/2011 | Feng et al. | |
| 2013/0075381 | A1 | 3/2013 | Wittkowski | |
| 2014/0246415 | A1* | 9/2014 | Wittkowski | B60N 2/5685 219/201 |
| 2014/0339217 | A1* | 11/2014 | Althaus | F24D 3/12 219/541 |

FOREIGN PATENT DOCUMENTS

| | | | |
|---|---|---|---|
| DE | 20 2006 007 228 | U1 | 10/2006 |
| DE | 202007014328 | U1 | 12/2007 |
| DE | 20 2007 014 328 | U1 | 1/2008 |
| DE | 202008007815 | U1 | 9/2008 |
| DE | 20 2008 007 815 | U1 | 10/2008 |
| DE | 202009000136 | U1 | 5/2009 |
| DE | 20 2009 000 136 | U1 | 6/2009 |
| DE | 20 2009 002 093 | U1 | 8/2009 |
| DE | 20 2009 011 565 | U1 | 2/2010 |
| DE | 20 2010 001 426 | U1 | 4/2010 |
| DE | 10 2009 034 306 | A1 | 3/2011 |
| DE | 10 2009 008 967 | B4 | 6/2011 |
| DE | 10 2012 000 445 | A1 | 9/2012 |
| DE | 20 2012 008 310 | U1 | 10/2012 |
| DE | 20 2012 009 982 | U1 | 11/2012 |
| DE | 10 2011 086 448 | A1 | 5/2013 |
| DE | 10 2010 045 066 | A1 | 3/2015 |
| WO | WO 9960823 | A1 | 11/1999 |
| WO | 2007/089118 | A1 | 8/2007 |
| WO | WO 2013/050621 | A2 | 4/2013 |
| WO | WO 2013/072338 | A2 | 5/2013 |

* cited by examiner

110 : heat reflective foil
120 : heat insulation layer
130 : flexible synthetic resin layer containing mesh
140 : mesh
150 : carbon nanotube coating 140 : mesh
142 : warp thread
144 : weft thread

*160* : thread
*162* : copper strand
*164* : coating

HEATING ELEMENT

BACKGROUND OF THE INVENTION

The invention relates to a plane heating element, comprising a mesh that is provided with a coating containing carbon nanotubes.

It is already known that carbon nanotubes (CNT) serve as heat source. CNT-based heating elements with a separate flat support have been disclosed in DE 10 2009 008 967 B4, DE 10 2009 034 306 A1, DE 20 2006 007 228 U1, DE 20 2007 014 328 U1, DE 20 2005 014 678 U1, DE 20 2008 007 815 U1, DE 20 2009 000 136 U1 as well as in WO 2007/089118 A1, said support carrying carbon nanotubes as well as a plurality of contacts, wherein the carbon nanotubes can be excited to emit infrared light by applying an electric voltage to the contacts.

A mesh that is coated with carbon nanotubes is described in DE 10 2011 086 448 A1.

SUMMARY OF THE INVENTION

A plane heating element is both flexible and effective.

DETAILED DESCRIPTION

Figure 2:
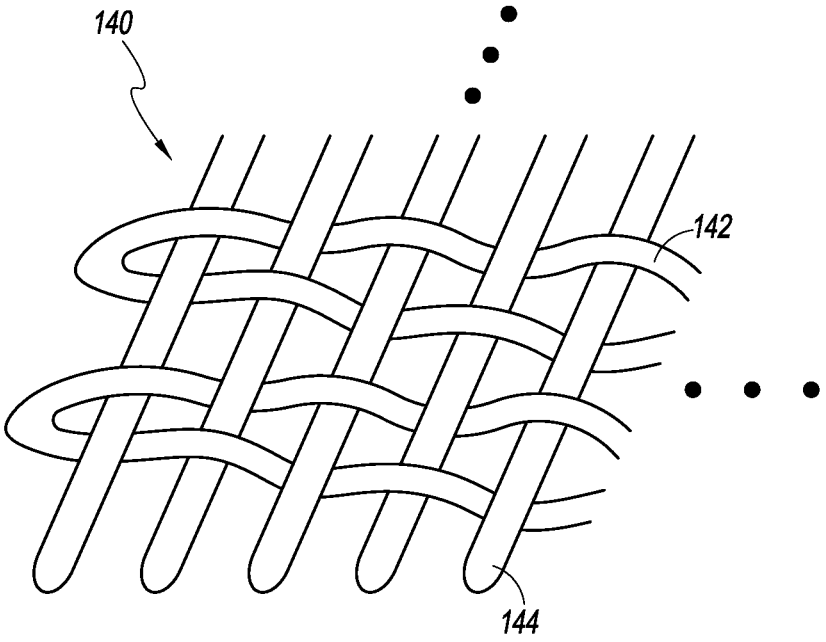
FIG. 2 illustrates a mesh according to an embodiment of the present invention.

In a first embodiment, the object the invention is based upon is solved with a plane heating element, comprising a mesh (140) that contains warp threads (142) and weft threads (144), as illustrated in FIG. 2, wherein a) thread material of 5% to 90% of the warp threads and/or the weft threads is electrically conductive, and b) at least 50% of the surface of the thread material is coated with a coating material comprising carbon nanotubes Provided it is used as a lawn heater, said plane heating element has the advantage that it can be installed significantly closer below the earth's surface and that the heat therefore does not need to be set so high to melt the snow or the ice on the lawn. Thus, in turn, the grass roots do not die off as easily and the lawn is conserved longer in spite of the lawn heater.

Another advantage is that the temperature can be delivered in such a way that it is distributed considerably more homogeneously across an area than is the case.

Figure 1:
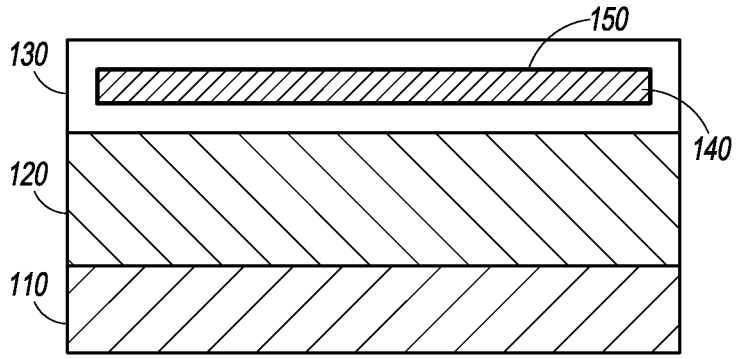
FIG. 1 illustrates a cross-sectional view of a heating element according to an embodiment of the present invention.

The heating element preferably comprises at least one thermal insulation layer, spaced apart 0.1 to 5 mm from the mesh. Said thermal insulation layer is preferably arranged only on one side of the mesh. As illustrated in FIG. 1, a heat-reflective foil (110) can preferably be applied, in particular laminated, onto the thermal insulation layer (120). This has the advantage that the heating element according to the invention emits as much of the generated heat as possible into only one direction. Surprisingly, it was additionally observed that the thermal insulation layer is preferably not applied directly onto the mesh, but spaced apart as mentioned. Many tests have shown that the heating element according to the invention can thus be operated in a safer manner and that there is no risk of the materials used overheating and possibly bursting into flames in case of electric voltage spikes in the heating element. Another advantage of the spacing is that the insulant generally is a type of material that can become soaked with moisture such as water and an electric contact can be prevented by the spacing.

The thermal insulation layer preferably has a density within a range of 15 to 200 kg/m3.

Regardless of the above, the thermal insulation layer preferably comprises a foamed material. Particularly preferably, the thermal insulation layer consists of a thermoplastic. Exceptionally preferably, the thermal insulation layer consists of a foaming material made of polyolefin, in particular polyethylene or polypropylene.

The thickness of the thermal insulation layer is preferably within a range of 3 to 50 mm.

The thermal conductivity (+30° C.) of the thermal insulation layer is preferably within a range of 0.01 to 0.06 W/mK. It can be measured according to the MSZ EN 12667:2001 E standard.

Figure 3:
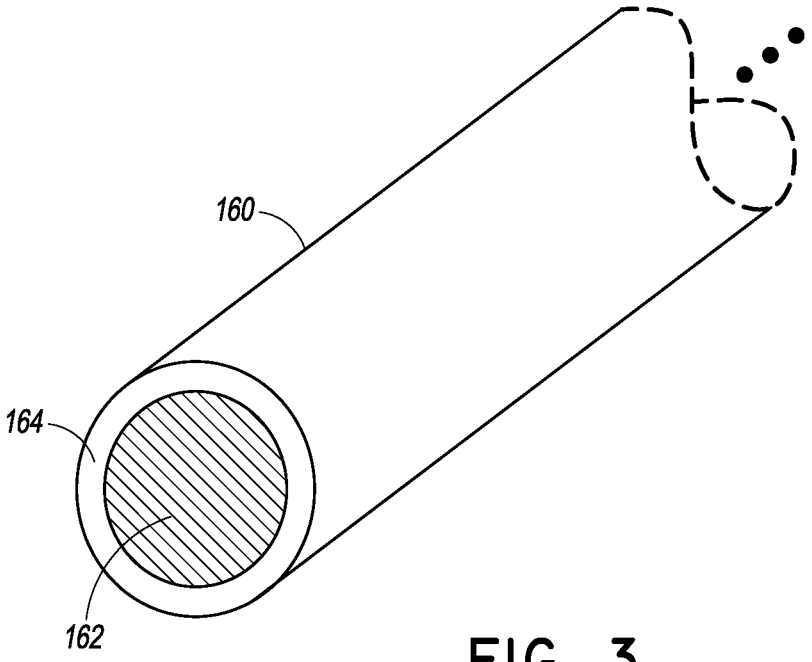
FIG. 3 illustrates a thread according to an embodiment of the present invention.

The warp threads and/or weft threads (142, 144, 160), whose thread material is electrically conductive, preferably consist of strands, particularly preferably copper strands (162) with a coating (164) as shown in FIG. 3.

Preferably, up to 20% of the warp threads and/or weft threads are electrically conductive.

The strands preferably comprise 25 to 200 wires, particularly preferably 50 to 150 wires. In the past, a strand with up to 20 wires was, for example, used in DE 10 2011 086 448 A1 for a similar, albeit not comparable application. In the present case, such a small number of wires had the disadvantage that the automated manufacture of the electrical connections was not possible in such a reliable fashion. Intuitively, the person skilled in the art would likely have selected a small number of wires, as he could save weight, costs and materials and as strands with fewer wires were commonly used for similar applications. Surprisingly, it was observed within the scope of this invention, that an unusually high number of wires has considerably improved the safety and reliability of the heating element according to the invention.

Preferably at least 50% of the strands are integrated into an electric circuit by way of a crimp connection, particularly preferably by way of a mandrel-style crimp connection or an F-style crimp connection. Up to now, the strands were soldered on in similar applications. The disadvantage of this was that the solder joint was often defective, because the carbon nanotubes had efficiently removed the heat and in the past, either the heating element was damaged as a result of excessive heat during the soldering or the solder joint was not conductive. Surprisingly, it was determined within the scope of the present invention that in particular with a mandrel-style crimp connection or an F-style crimp connection, a heating element is created which is more reliable as compared to the prior art. The connections are made preferably of copper.

The coating material preferably contains at least 10% by weight, particularly preferably at least 50% by weight, exceptionally preferably at least 90% by weight and most preferably 100% by weight of carbon nanotubes. The carbon nanotubes are preferably arranged anisotropically in the coating material. The coating with the coating material preferably has a thickness within a range of 0.1 to 100 μm. Particularly preferably, the carbon nanotubes have an average (median) length of 1 to 200 μm. Particularly preferably, the carbon nanotubes have an average (median) diameter of 5 to 20 nm.

Preferably at least 90%, exceptionally preferably 100% of the surface of the thread material is coated with a coating material (150) comprising carbon nanotubes, as illustrated in FIG. 1. Alternatively, the thread material can also be coated only on one side. This would be advantageous for applications such as a lawn heater or for wall installations, since most of the heat is only emitted into one direction.

Individual warp threads and/or weft threads made of electrically conductive thread material are preferably not surrounded by warp threads and/or weft threads made of non-electrically conductive thread material on both sides of the respective thread. Particularly preferably, warp threads and/or weft threads made of electrically conductive thread material are always arranged in groups of 3 to 10 adjoining warp threads and/or weft threads made of electrically conductive thread material.

The warp threads and/or weft threads preferably have a diameter of 0.1 to 5 mm, particularly preferably 0.2 to 0.8 mm.

The warp threads and/or weft threads are preferably spaced 2 to 50 mm apart from each other, in particular 3 to 10 mm apart from each other.

The mesh (140) is preferably cast in synthetic resin (130), as illustrated in FIG. 1. The weight per unit area of the synthetic resin is preferably within a range of 150% to 3,000%, in particular within a range of 300 to 1,000% of the weight per unit area of the mesh. Thus, the mesh can be spaced apart from the thermal insulation layer on the one hand. On the other hand, this can achieve the electrical insulation of the mesh. The mesh (140) cast in synthetic resin is preferably flexible. The synthetic resin (130) can comprise holes, which in turn are preferably arranged centrally in the loops of the mesh. Thus, the mesh can be permeable to water, which is important for uses such as a lawn heater.

An additional insulating layer can preferably be arranged around the coating material. Said insulating layer preferably comprises a thickness within a range of 0.1 to 4 mm. Said insulating layer preferably comprises an elastomer and exceptionally preferably a styrene butadiene copolymer. This has the advantage that the warp and weft threads are then fixed relative to each other, but in a flexible manner.

The heating element according to the invention preferably comprises a cover that surrounds the mesh and optionally the thermal insulation layer. Said cover is preferably spaced at least 0.2 mm, in particular at least 1 mm apart from the mesh.

The cover preferably comprises a support mesh. Said support mesh is preferably a mesh made of polyester. The yarn count of the support mesh is preferably within a range of 900 to 1,500 dTex and can be measured according to DIN EN ISO 2060. The weight per unit area of the support mesh is preferably within a range of 100 to 200 g/m2. The cover preferably comprises a thermoplastic material that is different from polyester. Said material is preferably PVC. The basis weight of the cover is preferably within a range of 300 to 600 g/m2. The cover preferably has a thickness within a range of 0.5 to 2 mm.

The heating element can be switched on and off, for example, by means of temperature sensors based on a set target temperature and/or by way of a self-learning control.

The heating element according to the invention can preferably be a lawn heater or be used as such. In that case, warp threads and/or weft threads are preferably spaced 4 to 80 mm, in particular 10 to 50 mm apart from each other. In that case, the electrically conductive threads are preferably the warp threads. Said electrically conductive warp threads can preferably be spaced 1 mm apart. Alternatively, the heating element according to the invention can be a room heater and/or exterior heater or be used as such.

The invention is explained below by means of an exemplary embodiment. The mesh consisted of glass fiber threads with a mesh width of 7×5 mm and with a width of 2.00 m, provided as a continuous roll of material. The textile comprised 7 copper threads made of copper strands having 72 wires instead of the glass fiber threads on each fifty successive weft threads made of glass fiber threads. All threads had a diameter of 0.5 mm each. A piece having a length of 1.40 m was cut from the roll of material.

Carbon nanotubes were applied to the finished woven textile in a three percent aqueous dispersion by immersion. The created coating was dried after every immersion. The coating process was repeated twice.

The dressing of the textiles was completed with the corresponding two-time application of a water-repellent and electrically-insulating protective layer made of styrene butadiene copolymer.

The copper threads were in each case electrically connected with a mandrel-style crimp connection.

The mesh was then coated twice with a commercially available PVC polymer, such that the mesh comprised a 1 mm-thick layer made of said synthetic material on both sides.

Next, a thermal insulation layer was applied all over one side of said compound. For this purpose, the cast mesh was laminated with 10 mm-thick Polifoam® FR C 3309 DN1 Flt from the company Trocellen.

Said compound was inserted into a tarpaulin cover (Hy-Tex® Keder H5533).

The heating element was connected in series to the electric current.

The heating capacity of the heating element was controlled by the supply voltage.

The features of the invention disclosed in the present description and in the claims can be essential to the realization of the invention in its various embodiments both alone as well as in any combination. The invention is not restricted to the described embodiments. It can be varied within the scope of the claims and taking into account the knowledge of the competent person skilled in the art.

What is claimed is:

1. A plane heating element, comprising a mesh that contains warp threads and weft threads, wherein a) thread material of 5% to 90% of the warp threads and/or weft threads is electrically conductive, and b) at least 50% of the surface of the thread material is coated with a coating material comprising carbon nanotubes.

2. The heating element according to claim 1, wherein the heating element comprises at least one thermal insulation layer, which is spaced at least 0.1 to 5 mm apart from the mesh.

3. The heating element according to claim 1, wherein the warp threads and/or weft threads, whose thread material is electrically conductive and consists of strands, particularly preferably copper strands.

4. The heating element according to claim 3, wherein at least 50% of the strands are integrated into an electric circuit by way of a crimp connection, particularly preferably by way of a mandrel-style crimp connection or an F-style crimp connection.

5. The heating element according to claim 1, wherein the coating material preferably contains at least 10% by weight, particularly preferably at least 50% by weight of carbon nanotubes.

6. The heating element according to claim 1, wherein individual warp threads and/or weft threads made of electrically conductive thread material are preferably not surrounded by warp threads and/or weft threads made of non-electrically conductive thread material on both sides, particularly preferably, warp threads and/or weft threads made of electrically conductive thread material are always arranged in groups of 3 to 10 adjoining warp threads and/or weft threads made of electrically conductive thread material.

7. The heating element according to claim 1, wherein the warp threads and/or weft threads have a diameter of 0.1 to 5 mm, particularly preferably 0.2 to 0.8 mm.

8. The heating element according to claim 1, wherein the mesh is cast in a synthetic resin.

9. The heating element according to claim 1, wherein the coating material comprises up to 90% by weight, particularly preferably up to 50% by weight of a thermoplastic and/or an elastomer.

10. A heating element according to claim 1, wherein the thermal insulation layer has a density within a range of 15 to 50 kg/m3.

* * * * *